US008474609B1

(12) United States Patent
Hong et al.

(10) Patent No.: US 8,474,609 B1
(45) Date of Patent: Jul. 2, 2013

(54) ELECTRONIC DEVICE CASE AND STAND

(71) Applicant: Uncommon LLC, Chicago, IL (US)

(72) Inventors: John Hong, Chicago, IL (US); William Welch, Los Altos, CA (US)

(73) Assignee: Uncommon LLC, Chicago, IL (US)

( * ) Notice: Subject to any disclaimer, the term of this patent is extended or adjusted under 35 U.S.C. 154(b) by 0 days.

(21) Appl. No.: 13/622,114

(22) Filed: Sep. 18, 2012

(51) Int. Cl.
*B65D 25/24* (2006.01)

(52) U.S. Cl.
USPC ..... 206/45.2; 206/320

(58) Field of Classification Search
USPC ..... 206/45.2, 45.23, 45.24, 576, 320, 206/701, 722
See application file for complete search history.

(56) References Cited

U.S. PATENT DOCUMENTS 4,259,568 A * 3/1981 Dynesen ..... 235/1 D
6,415,915 B1 * 7/2002 Grossman ..... 206/6
7,559,427 B2 * 7/2009 Hu ..... 206/764
8,143,982 B1 * 3/2012 Lauder et al. ..... 335/219
8,264,310 B2 * 9/2012 Lauder et al. ..... 335/219
8,282,065 B1 * 10/2012 Stone ..... 248/454

* cited by examiner

*Primary Examiner* — Jacob K Ackun

(74) *Attorney, Agent, or Firm* — Bishop & Diehl, Ltd.

(57) ABSTRACT

A cover for an electronic device having a first panel including a first and second edge, a second panel including a first and second edge and being positioned adjacent the first panel, a third panel including a first edge adjacent the second panel opposite the first panel, and means for connecting the first panel to a device holder or to the device itself. The cover may attach to a separate back panel which can be detachably secured to the electronic device. The second edge of the first panel, the first and second edges of the second panel and the first edge of the third panel are slanted so as to allow adjacent panels to be configured to form an angle to one another. The edges of adjacent panels are V-shaped and include two side-walls which abut when the panels move together. This limits the minimum angle between adjacent panels.

9 Claims, 3 Drawing Sheets

ELECTRONIC DEVICE CASE AND STAND

TECHNICAL FIELD OF THE INVENTION

The present device relates to covers and stands for electronic devices such as, for example, an Apple® iPad.

BACKGROUND OF THE INVENTION

The portability of electronic devices has led to a need for protecting such devices during transport. Whether it is being carried in a pocket, a purse, a backpack, or even a specially designed carrying case, the monetary investment of an electronic device almost certainly justifies the use of a protective case.

However, once put to use, the need for protecting the electronic device is greatly diminished. This is particularly true for tablet-type electronic devices, such as the Apple® iPad, which are occasionally used in seated settings and can be placed on a table or similar surface. In some cases, the tablet is more useful in a vertical (or slightly reclined) position. This upright position allows the tablet to have better viewability, but a separate stand is often needed to retain the tablet in such a position.

There are a limited number of prior art devices which provide combined protective and stand functionality, but such devices are more complicated and/or more bulky than the present device. A protective cover which folds easily and quickly into a stand for an electronic device has significant advantages over the prior art.

Until the invention of the present application, these and other problems in the prior art went either unnoticed or unsolved by those skilled in the art. The present invention provides a protective cover, which shields the electronic device from impacts and other destructive occurrences, and can be quickly folded into a multi-position electronic device stand without sacrificing portability features, design, style or affordability.

SUMMARY OF THE INVENTION

There is disclosed herein an improved electronic device cover which avoids the disadvantages of prior devices while affording additional structural and operating advantages.

Generally speaking, the disclosed cover for an electronic device comprises a first panel having a first edge and a second edge, a second panel having a first and second edge and being positioned adjacent the second edge of the first panel, a third panel having a first edge adjacent the second panel opposite the first panel, and means for connecting the first panel to a device holder or to the device itself.

In a specific embodiment, the cover attaches to a separate back panel which can be detachably secured to the electronic device. In all embodiments, the second edge of the first panel, the first and second edges of the second panel and the first edge of the third panel are slanted so as to allow adjacent panels to be configured to form an angle to one another. The preferred angle between adjacent panels is in the range of from about 45 degrees to about 90 degrees, and is more preferably in the range of from about 55 degrees to about 70 degrees.

In a specific embodiment, the slanted edges of adjacent panels are V-shaped and comprise two sidewalls which abut when adjacent panels are moved together, to thereby limit the minimum angle between the adjacent panels. The angle of the V-shaped sidewalls is approximately equal to that of the resulting adjacent panel angle.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
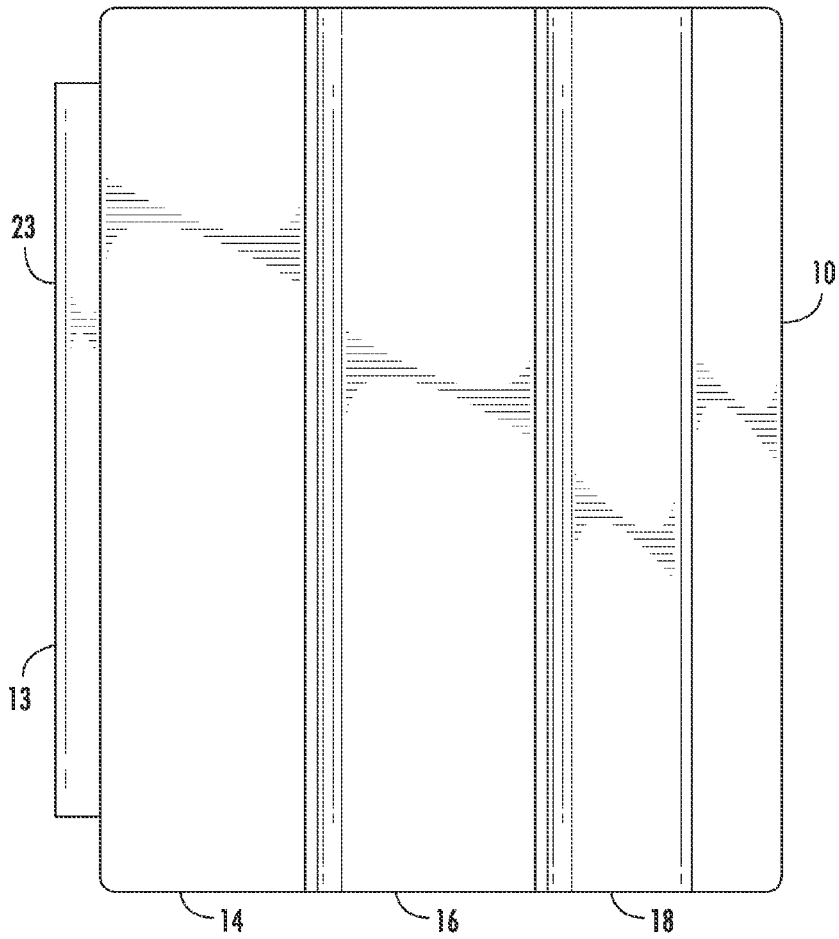
FIG. 1 is a top view of an embodiment of a cover in accordance with the present disclosure.
Figure 2:
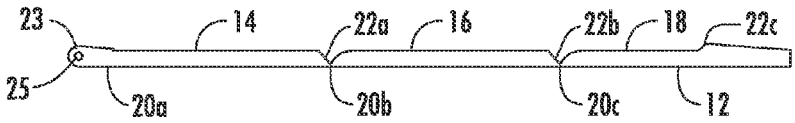
FIG. 2 is a side view of the cover of FIG. 1.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-6, there are illustrated embodiments of an electronic device cover, generally designated by the numeral 10. The particular illustrated cover 10 is for an Apple® iPad. In fact, while all the embodiments illustrated are directed to an iPad, it should be understood that the principles of the invention can be more broadly applied to most tablet-type electronic devices, as well as other types of electronic devices such as cell phones, notebook computers and the like, as long as there is a need for a protective cover and a stand.

As can be seen in the several figures, the cover 10 is comprised of a thermoplastic elastomer sheet (TPE) 12 overlaid with three textured panels: first panel 14, second panel 16 and third panel 18. Each of the panels 14, 16 and 18, is comprised of a first edge 20 and a second edge 22. The second edge 22*a* of first panel 14, the first edge 20*b* and second edge 22*b* of the second panel 16, and the first edge 20*c* of the third panel 18 are slanted or beveled, as shown best in FIG. 2.

In addition to the panels 14, 16 and 18, the cover 10 also comprises a means for connecting the cover 10 to one of either an electronic device (not shown) or a holder 30 for the electronic device. In the illustrated embodiment, the means for connecting 13 is a pinned hinge 23 having a plurality of connectors on the cover 10 and another surface—i.e., the electronic device or a holder—held together by at least one pin or rod 25, which then allows the cover 10 to pivot between an open and a closed position. Alternatively, the means for connecting 13 may be a magnetic strip (not shown) which extends from and along the first edge 20*a* of the first panel 14, much the way the hinge 23 is shown in FIG. 1. The magnetic strip can retain the cover 10 to an electronic device having a metal (i.e., ferrous) housing. In still another alternative embodiment, hook-and-loop (e.g., VELCRO®) may be similarly used to attach the cover 10 to the electronic device.

Figure 3B:
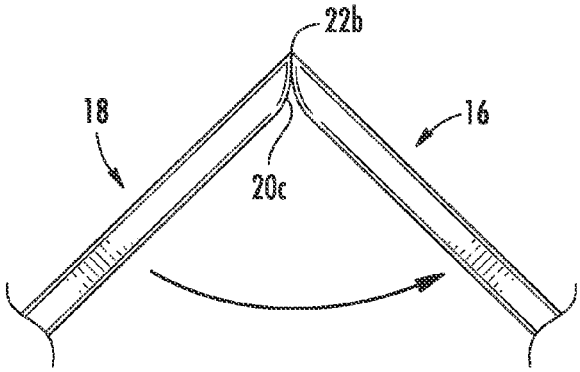
FIG. 3*b* is a partial close-up view of a corner shown in FIG. 3*a;*
Figure 3A:
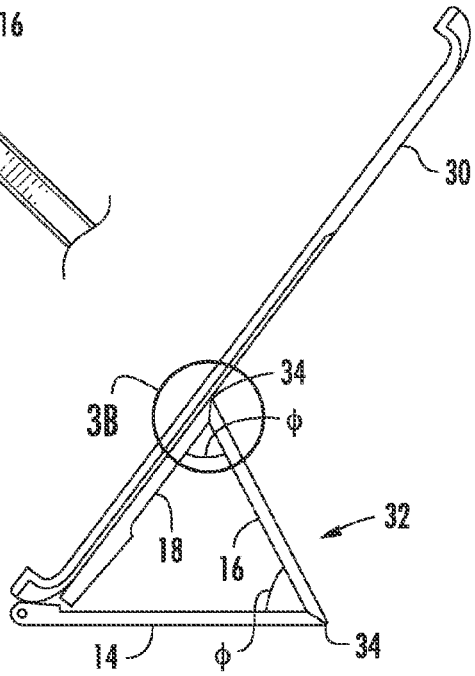
FIG. 3*a* is a side view of an embodiment of a cover and back panel in a first stand configuration.
Figure 4:
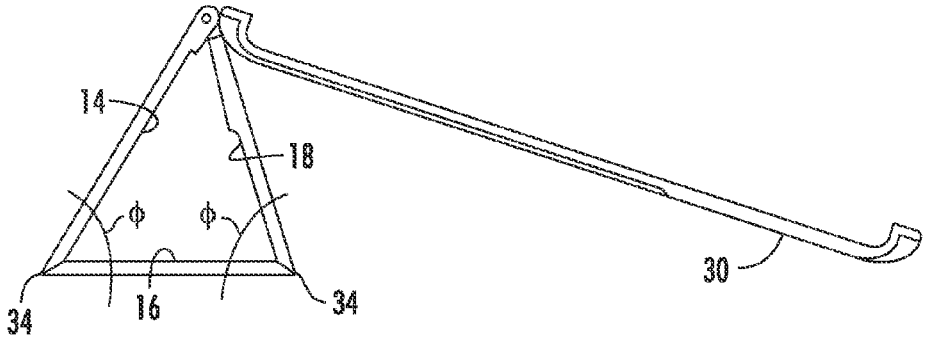
FIG. 4 is another side view of the embodiment of FIG. 3*a* in a second stand configuration.

As shown in FIGS. 3-4, a holder 30 may be used to secure the electronic device and provide protection as well. The holder 30 can be made of any rigid material, such as an aluminum or thermoplastic, and is typically designed to snap-fit onto the back of a device. As described above, the holder 30 may also provide for attachment of the cover 10. The attachment of the cover 10 to the holder 30 may be permanent, as with a hinge, or removable, as with VELCRO® or a magnetic strip.

Figure 5A:
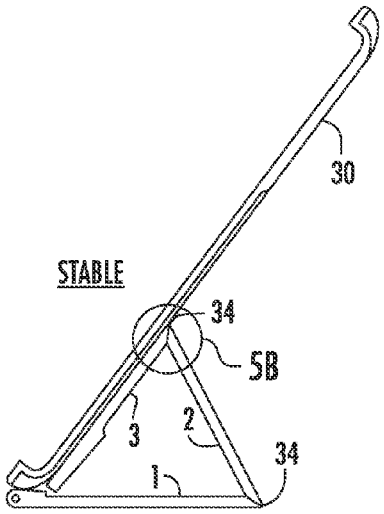
FIG. 5*a* is a side view of an embodiment similar to that of FIG. 3*a;*
Figure 5B:
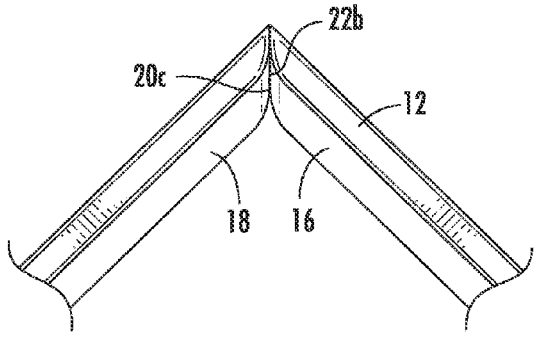
FIG. 5*b* is a partial close-up view of a corner shown in FIG. 5*a;*
Figure 6:
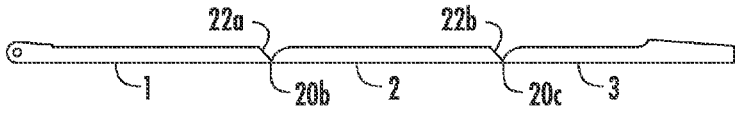
FIG. 6 is a side view of an embodiment similar to that of FIG. 2.

Referring to FIGS. 3*a* and 5-6, the operation of a stable multi-paneled cover 10 can be more readily understood. The panel edges, 20 and 22, are cut at an angle to allow the formation of a triangle 32. The cut edges, 20 and 22, comprise slanted sidewalls which together, when not in the triangle configuration 32, form a V-shape (see FIG. 6). The triangle configuration 32 allows the cover 10 to act as a stand for the electronic device. In fact, as shown in FIGS. 3 and 4, the triangle configuration 32 is capable of providing at least two distinct stand positions.

The triangle 32 is unyielding to the weight of the electronic device because of how each panel 14, 16, and 18, and specifically the cut edges, limits the angle at each corner 34. For example, when the triangle 32 is formed, the first edge 20*c* of the third panel 18 abuts the second edge 22*b* of the second panel 16 to hold an angle (θ). Likewise, the first edge 20*b* and second edge 22*a*, of the second panel 16 and first panel 14, respectively, also abut and hold an angle (ϕ). Angles θ and ϕ may be equal or different, depending upon the desired geometry desired for supporting the electronic device. Preferably the angles, θ and ϕ, are within the range of from about 45 to 90 degrees, and most preferably in the range of from about 60 to 75 degrees. The angle of the corner 34 depends on the angle of the two abutting cut edges.

Figure 7:
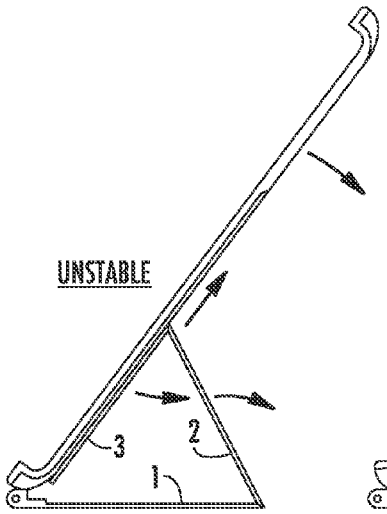
FIGS. 7 and 8 are illustrative of a cover without the novel aspects of the present invention.
Figure 8:
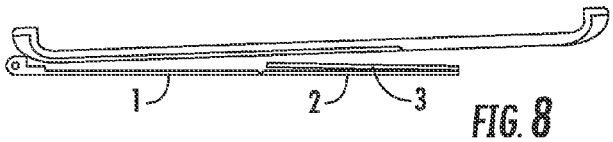

FIGS. 7 and 8 illustrate how an unstable cover without the cut edges of the present invention would react to the added weight of an electronic device. Specifically, panel no. 3 would fold inward toward panel no. 2, while panel no. 2 would pivot outward away from panel no. 1, as the weight of the electronic device pushes against panel no. 3. Eventually, and rather quickly, the three panels would flatten to the configuration of FIG. 8. A similar collapse would be expected to occur when the triangle configuration was subjected to other stand configurations (e.g., see FIG. 4).

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A cover for an electronic device, the cover comprising:

a first panel having a first edge and a second edge;

a second panel having a first and second edge and being positioned adjacent the second edge of the first panel;

a third panel having a first edge adjacent the second panel opposite the first panel;

a back panel for detachably securing to an electronic device; and means for connecting the first panel to the back panel, the means for connecting being positioned along the first edge of the first panel;

wherein the second edge of the first panel, the first and second edges of the second panel and the first edge of the third panel are slanted so as to allow adjacent panels to be configured to form an angle to one another, the angles between adjacent panels being in the range of from about 45 degrees to about 90 degrees.

2. The cover of claim 1, wherein the slanted edges of adjacent panels are V-shaped and comprise two sidewalls which abut, when adjacent panels are moved together, to thereby limit the minimum angle between the adjacent panels.

3. The cover of claim 2, wherein the cover is configured to fold along adjoining edges of adjacent panels by reducing an angle between the sidewalls.

4. The cover of claim 1, wherein the first, second and third panels have widths and the width of the third panel is less than the width of the second panel.

5. The cover of claim 4, wherein the width of the first panel is greater than the width of both the second panel and the third panel.

6. The cover of claim 2, wherein the angle of the sidewalls is in the range of from about 60 degrees to about 75 degrees.

7. The cover of claim 1, wherein the means for connecting comprises a magnetic connector.

8. The cover of claim 1, wherein the means for connecting comprises a hinged connector.

9. The cover of claim 1, wherein the means for connecting comprises hook-and-loop fastener.

* * * * *